US006940410B2

(12) United States Patent
Deacy

(10) Patent No.: US 6,940,410 B2
(45) Date of Patent: Sep. 6, 2005

(54) TOBACCO SMOKE DETECTION SYSTEM WITH TAMPER DETECTION

(76) Inventor: Dan Deacy, 7149 Canoga Rd., Auburn, NY (US) 13021

( * ) Notice: Subject to any disclaimer, the term of this patent is extended or adjusted under 35 U.S.C. 154(b) by 63 days.

(21) Appl. No.: 10/687,065

(22) Filed: Oct. 16, 2003

(65) Prior Publication Data

US 2005/0083205 A1 Apr. 21, 2005

(51) Int. Cl.[7] ..... G08B 17/10

(52) U.S. Cl. ..... 340/628; 340/506; 340/525; 340/693.6

(58) Field of Search ..... 340/628, 693.6, 340/506, 517, 522, 524, 525, 691.1, 691.4

(56) References Cited

U.S. PATENT DOCUMENTS

| | | | | | |
|---|---|---|---|---|---|
| 3,496,558 | A | | 2/1970 | Willson et al. | 340/237 |
| 4,074,225 | A | * | 2/1978 | Vandeweghe | 340/524 |
| 4,090,178 | A | | 5/1978 | Norris | 340/237 |
| 4,092,641 | A | * | 5/1978 | Bellinghausen et al. | 340/628 |
| 4,305,069 | A | | 12/1981 | Machen et al. | 340/628 |
| 4,549,168 | A | * | 10/1985 | Sieradzki | 340/525 |
| 4,630,037 | A | | 12/1986 | Escamilla, Jr. | 340/628 |
| 4,796,015 | A | | 1/1989 | Admire, Jr. | 340/693 |
| 5,686,885 | A | * | 11/1997 | Bergman | 340/506 |
| 6,208,252 | B1 | | 3/2001 | Danilychev | 340/577 |
| 6,545,608 | B1 | | 4/2003 | Kaufman | 340/577 |

* cited by examiner

*Primary Examiner*—Thomas Mullen
(74) *Attorney, Agent, or Firm*—Bernhard P. Molldrem, Jr.

(57) ABSTRACT

A smoke detection and monitoring arrangement detects surreptitious smoking in various zones in a building, e.g., rest rooms and break rooms, and also detects tampering. Each detection unit has an intake grille leading to a duct which contains an air flow detector, a smoke detector and an optical intrusion or tampering detector. Air flow may be induced by an internal fan, or may result from an optional connection to ventilation ductwork. Air flow, smoke, and tamper signals are fed from each unit to a central control panel, which may include visible indicators and an audible alarm.

14 Claims, 1 Drawing Sheet

TOBACCO SMOKE DETECTION SYSTEM WITH TAMPER DETECTION

BACKGROUND OF THE INVENTION

This invention relates to smoke detection and alarm systems, and is more specifically directed to a system for detecting presence of smoke, such as tobacco smoke, in one or more zones within a building structure. The invention is also directed to systems that detect and alert to attempts to block air flow through the detection unit or to defeat the detection of smoking.

The invention is more particularly directed to a technique for detecting smoke in a confined area, such as a meeting room, bathroom, or conference room, for the purpose of enforcing indoor clean air laws and regulations.

Because of concern for the health of workers and customers, many businesses, government offices, and other organizations have taken steps to limit smoking, and thus avoid exposing persons within their offices to second-hand smoke. This concern has also resulted recent government legislation and regulation to promote clean, healthy indoor air, for example, the New York Clean Indoor Air Act. These concerns, coupled with the existence of enforcement provisions and penalties in the clean indoor air legislation, has created a need among employers and business owners for an effective system to detect smoking by company employees, customers, and visitors. This is especially required in small semi-private areas such as rest rooms, lounges, and meeting rooms.

Smoke detectors of various designs are common and well known. However, there has been no smoke detector proposed previously that also includes some means for alerting the building staff or business owner if there is an attempt to block the flow of indoor air to the smoke detector, or for providing a discreet alert to a central location if some attempt has been made to disarm the smoke detector, i.e., by simply unplugging it or cutting its signal wires.

Prior proposed arrangements for assisting in smoking rules enforcement include a combination smoke detector and flame detector, which may be situated behind the grille of a ventilating air duct, and hidden from view for detecting surreptitious smoking, e.g., in a rest room. One such system is described in U.S. Pat. No. 6,545,608 to Kaufman. A smoking violation detector that may be incorporated into the roof of a portable toilet cabin has been described in U.S. Pat. No. 4,630,037 to Escamilla, Jr. In each case, detection of cigarette smoke by the unit can trigger an audible or visible alarm situated outside the room or area being monitored.

However, detection apparatus of the prior art have not concerned themselves with attempts to defeat the smoke detector, and no one has previously incorporated an intrusion or tamper detector, nor has anyone incorporated an airflow detector to alert to the absence of air flow from the monitored zone past the smoke monitor. In addition, the systems of the prior art have not addressed the need for a central monitoring station to continuously monitor the status of the detection units in several different zones within the building structure, nor have they concerned themselves with the need for a central monitoring station to distinguish between various events, such as presence of smoke, tampering, or absence of sufficient air flow affecting operative status of the respective units.

OBJECTS AND SUMMARY OF THE INVENTION

Accordingly, it is an object of this invention to provide a smoke detection and monitoring system which overcomes the drawbacks of the prior art.

It is another object to provide a smoke detection unit that can be installed in a given zone within a building structure, and which also features tamper detection.

It is a further object to provide a smoke detection system with tamper detection, with detection units provided in each of several zones within the building and with a central monitor panel that indicates when smoke is detected at each zone, and also indicates detected tampering with a detection unit, e.g., attempting to cover the intake grille to block air flow, as well as indicating operative, in-service status of the units.

It is a still further object to provide a smoke detection system which is simple in construction and is easy to install and use.

In accordance with one aspect of this invention, a smoke detection and monitoring arrangement is provided to detect and monitor the presence of smoke within one or more zones of a building structure. There are one or more detection units, each being positioned to monitor the air within a respective zone within the structure. Each detection unit includes a duct, an intake grille for admitting air from the zone into said duct, a low-volume smoke detector positioned within the duct, and means inducing an air flow in through said intake grille into said duct. The latter may be a connection conduit that attaches the main duct to an exhaust vent, such as the restroom exhaust, although it is possible to connect it with the building HVAC system. Alternatively, the air flow inducing means may include a small low-volume fan installed in the duct. Preferably, an air flow detector, e.g., a paddle switch, senses air flow or the absence of air flow through the duct. Alternatively, a vane-actuated switch could be used here. There is also an optical tamper detector positioned at the intake of the duct, most preferably at the center of the intake grille.

At a monitoring station remote from the zone in question, a main control panel provides visible indication of smoke and of tampering in each said zone being monitored. A communication link connects the detection units with the control panel, and may include wires or wireless communication between the tamper detector, the smoke detector, and flow switch of each said detection unit and the main control panel.

In a preferred embodiment, the unit mounts in the ceiling in the rest room, lounge, or other building zone, and can either connect with a general HVAC duct system or simply vent air back into the room. In a preferred example, there is a vent pipe or duct, with a small vent fan, and at the inlet grille there is an optical intrusion detector to detect tampering or blocking of flow of air. This detects a cover, if placed over the grille, and detects items being inserted through the grille, if that occurs. A smoke detecting sensor is mounted within the air flow in the pipe or duct. If smoke enters the vent pipe, the detector senses it, and a small sender associated with the detector signals to the central monitor station elsewhere in the building, and can sound an alarm. There may or may not be a local alarm as well, i.e., to alert the smoker that his or her smoking has been detected. Also, if there is any tampering detected, i.e., by the optical detector, then that also sends a signal to the control panel at the monitor station. A display at the monitor station shows (a) if either smoke or tampering is detected, or both, and (b) the identity or location of the sensor, e.g., second floor women's bathroom, break room, etc. There may also be an air flow detector that signals if there is blockage of air flow, and whether the fan is working. In some situations it is may also be necessary to control the air pressure within a particular room or compartment, so as to ensure that any air escaping moves is a particular direction, i.e., in or out of the room, and the air flow detection may also provide indication of that status.

The above and many other objects, features, and advantages of this invention will become apparent to persons skilled in the art from the ensuing description of a preferred embodiment, which is to be read in conjunction with the accompanying Drawing.

DETAILED DESCRIPTION OF THE PREFERRED EMBODIMENT

Figure 1:
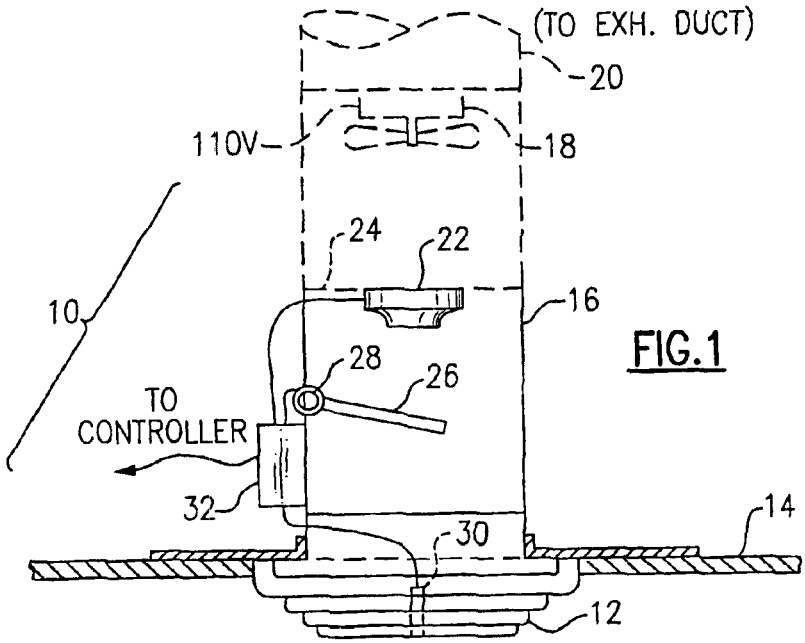
FIG. 1 is a sectional view of a smoke detection and tamper indicating unit according to one embodiment of this invention.

With reference to the Drawing, and initially to FIG. 1 thereof, smoke detection unit 10 in this embodiment is adapted to be mounted in the ceiling of a room, and has a front grille 12 (here, a ceiling grille) that is supported in a frame 14. In this case, the frame may be a two-foot by two-foot square matching the footprint of a standard ceiling tile, so that it may be fitted into a tile aperture in the gridwork of a standard drop ceiling. Above the grille 12 a duct 16 extends upward. Here the duct 16 may be a tubular duct of six-inch diameter, but the dimensions are not critical. In one option, a small, low-volume fan 18 is mounted at an upper end of the duct 16, and simply moves air from the zone, i.e., the room below the ceiling, into the space above the ceiling, where it circulates back into the room. In another option, a conduit 20 continues to attach with the exhaust ductwork of the building ventilation system. In either case, a flow of air is induced upwards through the grille and through the duct 16. Where the fan 18 is employed, a power cord may connect with a source of 110 to 120 volts AC, or a low voltage fan may be used, supplied from a transformer supply (not shown).

Figure 2:
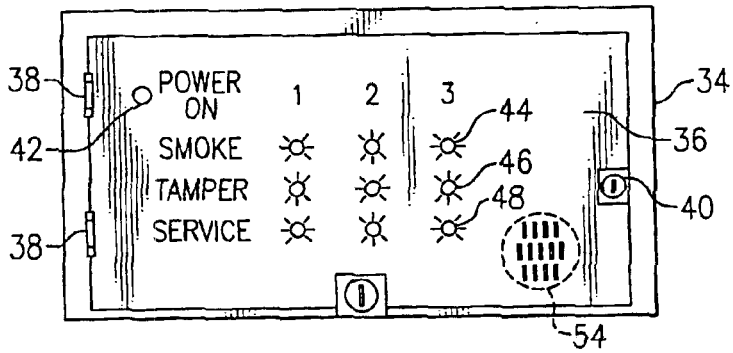
FIG. 2 is a front elevation of control panel of a central monitoring station according to this embodiment.

A low air flow smoke detector 22 is supported on a support web 24 within the duct 16, so that the detector 22 is centered across the flow axis of the duct. A lightweight paddle 26 is pivotally mounted at one side of the duct beneath the smoke detector 22, and actuates a microswitch 28 to indicate the presence (or absence) of sufficient air flow. An optical detector 30, i.e., a photo proximity switch, is mounted within the duct just above the intake grille 12, and serves to detect tampering, such as the intrusion of objects into the grille, or attempts to block or cover the air intake grille. As shown, an electrical box 32 positioned on the exterior of the duct 16 receives feeds from the smoke detector 22, the air flow microswitch 28 and the detector 30, and has an output wire or wiring harness that leads to a central monitoring station where they connect with a control panel 34, which is shown in FIG. 2.

Similar detection units 10 are installed in each of the zones that need to be monitored, i.e., men's rest rooms, ladies' rest rooms, employee lounges, etc, for compliance with smoking rules. Each of the detection units would be wired to communicate between its respective zone and the control panel 34.

In this embodiment, the control panel 34 has a lockable front cover 36, with hinges 38 at the left and a key lock 40 at the right. An authorized building employee may open this with the key to reset the control panel.

Figure 3:
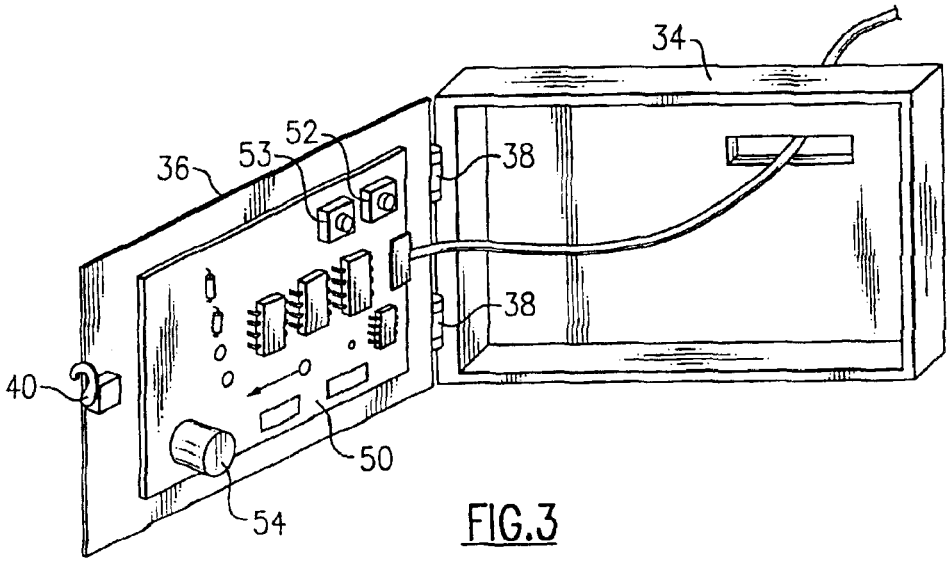
FIG. 3 shows the control panel thereof with its door closed.

Various indicating lamps or LEDs are situated on the cover 36, including a Power ON LED 42, a set of smoke detection indicator LEDs 44, one for each zone, a set of tamper indication LEDs 46, also one for each zone, and a set of service requirement LEDs 48. Within the control panel 34, as shown in FIG. 3, is a DC printed circuit board 50 containing various electronic components, on which is mounted also one or more reset push buttons 52, as well as a silence push button 53, which may only be actuated if the cover 36 is unlocked and opened. A buzzer or sounder 54 is located behind slots or grille openings on the front cover 36.

In the illustrated embodiment, the control panel is designed for three zones, i.e. three detection units 10. However, there may be more or fewer, depending on the user's needs.

The printed circuit board 50 within the control panel is powered by a standard 110–120 volts. The board will have terminal strips for the three zones (in this embodiment) and a common output. Preferably, the board 50 is mounted on the inside of the cover or door 36 of the panel. The reset switch 52 and silence switch 53 are mounted on the board 50 inside the locked control panel, so that the system will continue to give a smoke detection or tampering indication, or both, for the zone in question until all alarm trips, tamper trips, and service signal have been cleared. Also, inside the control panel is a silence switch, or switches, that will silence all alarms for smoking, tamper, and service. The audible alarm may be constituted by the buzzer sounding constantly for smoke or tamper occurrences, and a broken or intermittent signal for service alarms, e.g., one second of buzzing followed by nine seconds of silence each ten seconds. The signals here may be coded, i.e., one buzz for zone one, two buzzes for zone two, etc. The service requirement LEDs 48 also serve to indicate the operative/inoperative status of the respective detection units 10, i.e., operability of the smoke detector 22, the tamper detector 30, and the flow switch 28.

In the detection units 10, the smoke detector 22 may include standard three-wire smoke detector, and the air flow detection microswitch 28 may be standard two wire switch. The tamper or intrusion detector 30 may include a two-wire photo proximity detector.

The air flow detector 28 gives a positive indication of operation, i.e., ON when there is normal air flow, and will go OFF if air flow is blocked or if the fan 18 fails to function. Alternatively, the fan power, or a rotation detector on the fan 18, may be employed to sense fan operation. Also, inoperativeness or failure of either the tamper detector 30 or the smoke detector 22 will result in a service signal to the control panel.

The smoke detection signal and tamper signal will light the respective Zone 1, Zone 2, Zone 3 LEDs 44, 46 on the cover. In the embodiment illustrated in FIG. 2, the service LEDs 48 are installed on the cover 36.

While wired connections are used here between the detection units 10 and the central monitoring station control panel 34, a wireless (e.g., radio) or optical system could be employed.

The signal should be able to travel distances on the order of five hundred feet or more, without problem in most instances, between the detection units and the control panel.

While the invention has been described in detail with respect to a preferred embodiment, it should be recognized that there are many alternative embodiments that would become apparent to persons of skill in the art. Many modifications and variations are possible which would not depart from the scope and spirit of this invention, as defined in the appended claims.

I claim:

1. Smoke detection and monitoring arrangement for monitoring presence of smoke within one or more zones of a building structure, comprising:

one or more detection units each being positioned within a respective zone within the structure, each said detection unit including a duct, an intake grille for admitting air from the zone into said duct, an optical tamper detector positioned at said grille, a low-volume smoke detector positioned within said duct, and means inducing an air flow in through said intake grille into said duct;

a main control panel providing visible indication of smoke and of tampering in each said zone being monitored; and means communicating between the tamper detector and the smoke detector of each said detection unit and said main control panel.

2. Smoke detection and monitoring arrangement according to claim 1 wherein said means for inducing an air flow includes a length of duct work adapted to connect said duct with an exhaust vent.

3. Smoke detection and monitoring arrangement according to claim 1 wherein said means for inducing an air flow includes a fan positioned within said duct.

4. Smoke detection and monitoring arrangement to claim 1 wherein said one or more detection units includes, an air flow detector within said duct, and said means for communicating includes means for signalling to said control panel when airflow is present.

5. Smoke detection and monitoring arrangement according to claim 4 wherein said air flow detector includes a vane positioned across the axis of air flow in the duct.

6. Smoke detection and monitoring arrangement according to claim 5 wherein said main control panel includes a service signalling means for indicating operative/inoperative status of the respective detection unit or units.

7. Smoke detection and monitoring arrangement according to claim 6 wherein the service signalling means is responsive to status of the air flow detector.

8. Smoke detection and monitoring arrangement according to claim 6 wherein the service signalling means is responsive to operability of the smoke detector of the respective detection unit.

9. Smoke detection and monitoring arrangement according to claim 1 wherein said main control panel includes a lockable enclosure having a locking front cover, and indicator lamps indicating for each zone, respectively, smoke detection and tamper indication.

10. Smoke detection and monitoring arrangement according to claim 9 wherein said main control panel further includes an audible alarm sounder situated within said lockable enclosure.

11. Smoke detection and monitoring arrangement according to claim 10, further including a reset button within said lockable enclosure for permitting the sounder to be reset to OFF only by first unlocking the enclosure.

12. Smoke detection and monitoring arrangement according to claim 1 wherein said intake grille is adapted to be mounted in a standard 2-foot by 2-foot aperture of a dropped ceiling.

13. Smoke detection and monitoring arrangement according to claim 1 wherein said optical tamper detector situated at a center of said grille.

14. Smoke detection and monitoring arrangement according to claim 1 wherein said optical tamper detector includes a photo presence switch.

* * * * *